United States Patent [19]

Hedge et al.

[11] Patent Number: 4,641,665

[45] Date of Patent: Feb. 10, 1987

[54] EXPANSION OF TOBACCO

[75] Inventors: Roger W. Hedge, Lymington; Ian C. Brown, Winchester, both of England

[73] Assignee: British-American Tobacco Company Limited, London, England

[21] Appl. No.: 744,806

[22] Filed: Jun. 14, 1985

[30] Foreign Application Priority Data

Jun. 23, 1984 [GB] United Kingdom ..... 8416084

[51] Int. Cl.[4] ..... A24B 3/18

[52] U.S. Cl. ..... 131/296; 131/291

[58] Field of Search ..... 131/291–296

*Primary Examiner*—V. Millin

*Attorney, Agent, or Firm*—Kane, Dalsimer, Kane, Sullivan and Kurucz

[57] ABSTRACT

A tobacco expansion agent capable of synergistic tobacco expansion comprises a first organic compound which is volatile, non-polar and substantially water insoluble and a second organic compound which is volatile, water soluble, oxygen containing and of a polarity in excess of that of the first compound.

19 Claims, 3 Drawing Figures

EXPANSION OF TOBACCO

BACKGROUND OF THE INVENTION

1. Field of the Invention

This invention relates to tobacco expansion agents and to tobacco expansion processes.

2. Brief Description of the Prior Art

It is a well-established practice in the tobacco industry to subject tobacco to a process which results in an increase in the filling power of the tobacco. Such a process is often referred to as a tobacco expansion process. In prior proposed tobacco expansion processes, tobacco lamina or tobacco stem is impregnated with an expansion agent. Thereafter the tobacco may be subjected to a heating step, usually comprising contact between the tobacco and a heating medium such, for example, as hot air and/or steam. The heating step effects removal of the expansion agent from the tobacco. In some of these expansion processes, it is during such a heating step that the expansion of the tobacco takes place.

As an alternative to a heating step, the tobacco, initially at an elevated pressure and temperature, may be subjected to a sudden reduction in pressure. A further alternative is freeze-drying.

Among the expansion agents used in prior proposed expansion processes are water, steam, air, nitrogen, carbon dioxide, sulphur dioxide, ammonia, hydrocarbons and halogenated hydrocarbons.

According to a tobacco expansion process described in United Kingdom Patent Specification No. 955,679, tobacco is subjected to a solvent in liquid form selected from the group comprising aliphatic hydrocarbons, cyclic hydrocarbons, aromatic hydrocarbons, alcohols, ketones, ethers, esters, chlorinated solvents and combinations of said group of solvents which are miscible. The liquid solvent is removed by, for example, blowing air through the tobacco.

In U.S. Pat. No. 3,693,631 there is described a tobacco expansion process in which a volatile organic compound or compounds is/are used to impregnate the tobacco. According to the teaching of this specification, preferred organic compounds are non-oxygenated compounds which are relatively non-polar and relatively or substantially immiscible in water.

In U.S. Pat. No. 3,425,425 there is described a process for expanding tobacco stems in which the stems are treated with a solution comprising one or more sugars and one or more of a sodium or potassium salt of an inorganic or organic acid, a mono or di-basic acid or sodium or potassium hydroxide. After treatment with the solution, the stems are dried and then heated to a temperature of, for example, 300° C.

A tobacco expansion process in which tobacco is treated with ammonia and carbon dioxide is described in U.S. Pat. No. 3,771,533. The ammonia and carbon dioxide treated tobacco is then heated and/or subjected to reduced pressure.

In Publication Document No. 107,932 of European Patent Application No. 83305989.2 there is a description of a tobacco expansion process in which tobacco is treated with an expansion agent in the vapour phase under elevated temperature and pressure conditions. Subsequently the pressure is released. The preferred expansion agents are the light hydrocarbons, ethane, propane, propylene, n-butane, isobutane, dichlorodifluoromethane and monochlorodifluoromethane. It is stated that mixtures of expansion agents may be used satisfactorily.

Although there has been mention in the patents literature of the use in tobacco expansion processes of expansion agents comprising two or more components, there has, to the best of our knowledge, been no teaching of the provision of a tobacco expansion agent comprising first and second components which is capable of producing a synergistic effect in terms of tobacco filling power increase when employed in a tobacco expansion process. For a two-component expansion agent to exhibit synergism, the filling power increase effected by the agent would have to be greater than the increase expected on a linearly proportional basis from the increases for each of the components.

It is an object of the present invention to provide tobacco expansion agents which exhibit synergism.

It is a further object of the present invention to provide tobacco expansion agents comprising first and second components, in the use of which agents in tobacco expansion processes, increases in tobacco filling power are obtainable which are greater than would be obtained using either of the first and second components alone.

SUMMARY OF THE INVENTION

The present invention provides a tobacco expansion agent comprising as a first component a first organic compound which is volatile, non-polar and substantially water insoluble, and as a second component a second organic compound which is volatile, water soluble, oxygen containing and of a polarity in excess of that of said first compound. Preferably, the first compound and the second compound are miscible when each is in the liquid phase. Such expansion agent is referred to hereinbelow as "an expansion agent as hereinabove defined".

The first compound is preferably a hydrocarbon, suitably one having from one to eight carbon atoms in its molecular structure, and more suitably from three to six carbon atoms in its molecular structure. A hydrocarbon used as the first compound may be straight chain, branched, saturated, unsaturated, cyclic or substituted.

Suitably, the second compound is a compound which has from one to six carbon atoms in its molecular structure, and more suitably from one to three carbon atoms. The second compound may be, for example, a ketone, an ester, or an alcohol, although preferably not an aldehyde or an ether.

It is desirable that the first and second compounds should be capable of forming an azeotrope. Where the first and second compounds are capable of forming an azeotrope, it is preferable to use proportions of the compounds at or in the region of the azeotropic proportions.

Advantageously, each of the first and second compounds exists in the liquid phase at or near 20° C. and at one bar (100 kPa) absolute pressure. It is also of advantage for the respective atmospheric pressure boiling points of the first and second compounds to be reasonably close to each other, within 50° C. say.

We have found that by resort to the present invention tobacco expansion agents may be provided which exhibit a synergistic tobacco expansion effect.

We have also found that by use of expansion agents in accordance with the present invention, increases in tobacco filling power are obtainable which are very considerably in excess of filling power increases obtained using known mono-component organic expansion agents.

The present invention also provides a tobacco expansion process wherein tobacco is treated with an expansion agent as hereinabove defined and the thus treated tobacco is subjected to heating and/or a reduction in pressure. It is within the scope of the inventive method to add the first and second component compounds to the tobacco independently of each other, thus to effect an in situ mixing of the compounds to provide the expansion agent. Advantageously, the heating and/or pressure reduction step effects removal of the agent from the tobacco.

Lamina and/or stem tobaccos may be expanded by the process of the present invention.

According to one method of carrying out the process, the tobacco, treated with the expansion agent, is heated in a closed pressure vessel so that the temperature of the agent in the liquid phase in the tobacco attains a temperature value above the boiling point of said agent corresponding to a release pressure lower than the pressure in the vessel at the aforementioned temperature value. Subsequently the pressure vessel is suddenly vented to the release pressure. Conveniently, the release pressure is a sub-atmospheric pressure although it may, in accordance with the expansion agent used, be atmospheric pressure or even a super-atmospheric pressure.

According to another method of carrying out the process of the present invention, the tobacco, treated with the expansion agent, is fed into a duct through which flows a gaseous heating medium, nitrogen at an elevated temperature or superheated steam for example. The tobacco particles are conveyed along the duct by the gaseous medium and are then separated from the gaseous medium by separator means.

In order to illustrate the present invention, by way of example, tobacco expansion processes will now be described.

DETAILED DESCRIPTION OF THE PREFERRED EMBODIMENTS OF THE INVENTION

The following examples describe the manner and process of carrying out the invention and set forth the best mode contemplated by the inventors but are not to be construed as limiting the scope of the invention.

Figure 1:
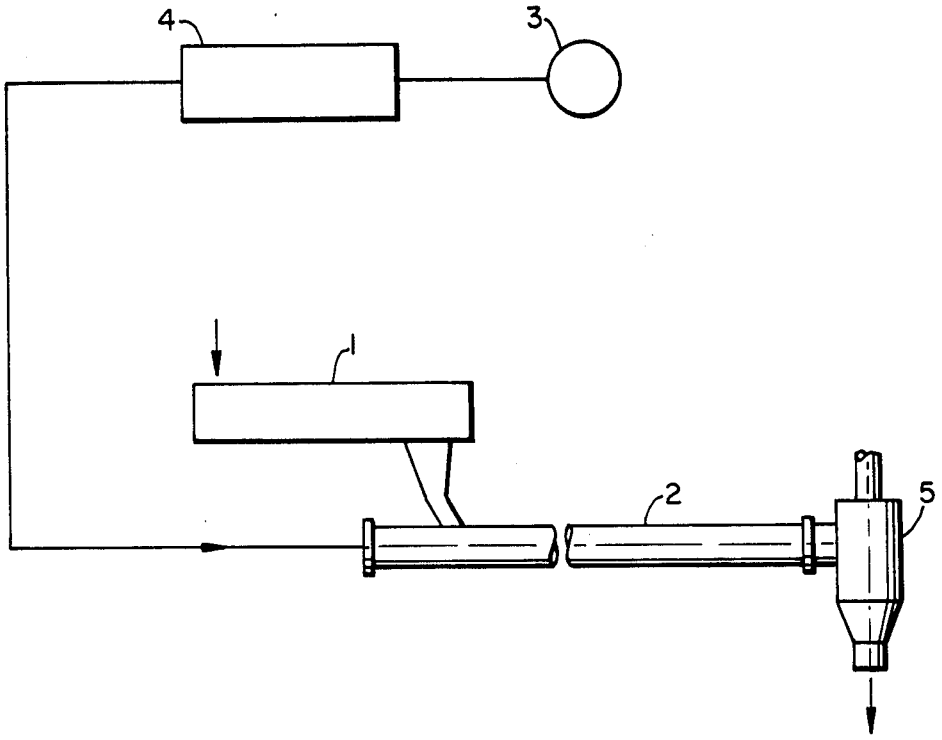
FIG. 1 diagrammatically depicts tobacco expansion apparatus used in carrying out the tobacco expansion process of Example I. A similar apparatus was used in respect of Examples II–VII and Examples XII–XIX.

EXAMPLE I 500 g of tobacco, being an 80%:20% by weight blend of flue-cured lamina and stem tobaccos, was conditioned to a wet weight moisture content of 18%. An expansion agent comprising 180 g n-pentane and 145 g acetone was added to the tobacco. After a six hour equilibration period, the tobacco was fed through an enclosed band-feeder 1 (see FIG. 1) into a 5 cm internal diameter linear expander tube 2 through which steam flowed at a flow rate of 25 m $sec^{-1}$. The steam, which was supplied from a steam supply main 3 via a steam heater 4, had an initial temperature of 300° C. After a travel path of 3 m within the expander, the tobacco was separated from the conveying steam in a cyclone separator 5. The tobacco was then equilibrated to 12.5% wet weight moisture content and determinations made of its filling value and particle specific volume. The increase in the filling value of the tobacco, compared with unexpanded control tobacco also equilibrated to 12.5% wet weight moisture content, was 130% and the increase in particle specific volume was 169%.

When under the same conditions n-pentane was used alone, the filling value and particle specific volume increases were 64% and 84% respectively. The corresponding values for acetone when used alone, under the same conditions, were 65% and 91%. Clearly, the mixture of n-pentane and acetone provided a tobacco expansion agent far superior to either of its components when used alone.

The measurements of filling value and particle specific volume were made using a manually operated filling value/impedance test instrument as described in United Kingdom Patent Specification No. 2 128 758 A.

Filling value (FV) was obtained from the relationship $$FV = \frac{\pi\,(3.25)^2\,h}{W}$$

where:

3.25 is the radius of the cylinder of the test instrument (cm)

h is the height of the tobacco column (cm)

W is the weight of the tobacco column (g)

The measurements of particle specific volume (PSV) were obtained by way of a linear regression of bulk density against $$\left(\frac{D^2h}{1.42\,p}\right)^{\frac{1}{2}}$$

where:

D is the bulk density of the tobacco (g $cc^{-1}$)

h is the height of the tobacco column (cm)

p is pressure drop through the tobacco column (cm $H_2O$)

1.42 is a correction factor for flow through the column

The D axis intercept is a measure of particle density and the reciprocal of this is particle specific volume.

EXAMPLE II

Six runs were made of a tobacco expansion process, the process parameters being common for all of the runs, except that the composition of the expansion agent was varied as shown below.

| Run No. | n-Pentane (% vol) | Acetone (% vol) |
|---|---|---|
| 1 | 100 | 0 |
| 2 | 90 | 10 |
| 3 | 80 | 20 |
| 4 | 75 | 25 |
| 5 | 50 | 50 |
| 6 | 0 | 100 |

For each of the runs 500 g of tobacco, being a blend wholly comprised of flue-cured lamina tobaccos, at a moisture content of 22% wet weight was treated with 350 g expansion agent of the n-pentane/acetone composition particular to the run.

After a four hour equilibration period, the tobacco was fed through an enclosed band-feeder into a linear expander tube, the feed rate being 200 g/min. The expander tube was 12 m long and of 5 cm internal diameter. The steam flow rate within the tube was 50 m $sec^{-1}$ and the initial temperature of the steam was 350° C. At the outlet end of the tube the tobacco was separated from the conveying steam in a separator.

The thus expanded tobacco was equilibrated to 12.5% wet weight moisture content before determinations were made of filling value and particle specific volume. The FV and PSV determinations were made using an instrument similar to that of Specification No. 2 128 758 A, but which was fitted with an automatically operable plunger. The increases in FV and PSV, as compared to unexpanded, equilibrated control tobacco, were found to be as shown below.

| Run No. | FV Increase (%) | PSV Increase (%) |
|---|---|---|
| 1 | 77 | 126 |
| 2 | 108 | 161 |
| 3 | 118 | 177 |
| 4 | 110 | 169 |
| 5 | 96 | 172 |
| 6 | 36 | 59 |

It may be observed that for Runs 2–5, in which the expansion agent comprised both n-pentane and acetone, the FV and PSV increases were greater than for Run 1, in which n-pentane only was used, and for Run 6, in which acetone only was used. It may be further observed that the run which resulted in the greatest FV and PSV increases was Run 3. The expansion agent used in Run 3 comprised 80% n-pentane and 20% acetone. These proportions approximate to the azeotropic proportions for n-pentane and acetone. It is thus deduced that for an expansion agent comprising these two components, optimal synergism is to be obtained by using the components at or near the azeotropic proportions thereof.

Figure 2:
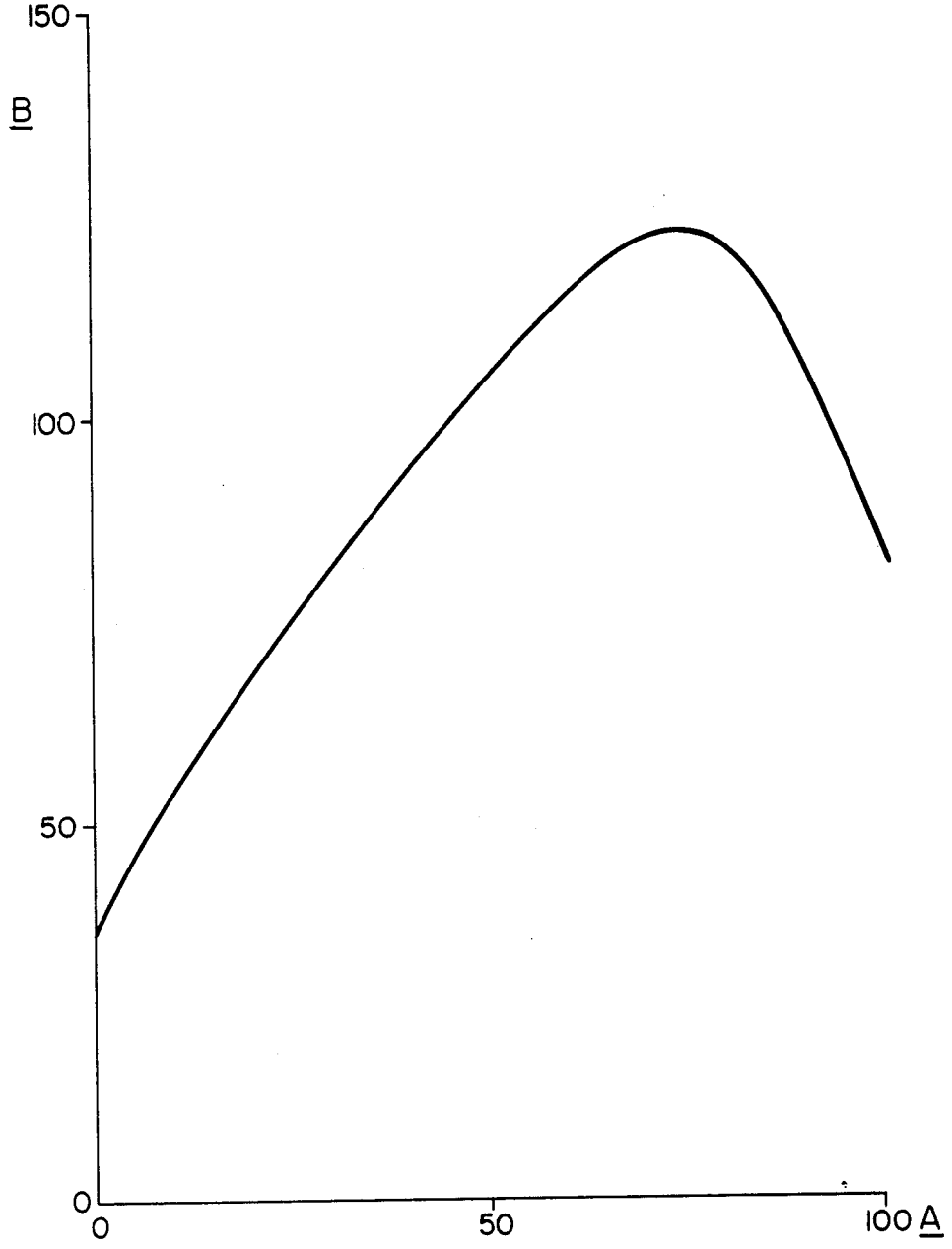
FIG. 2 is a graph showing results obtained from the process of Example II.

The FV increase results are shown graphically in FIG. 2, in which axis A represents the percentage of n-pentane in the expansion agent and axis B represents the percentage FV increase.

EXAMPLES III–VII

Using again a blend wholly comprised of flue-cured lamina tobaccos, the expansion process of Example II was repeated five times, using each time a different two-component expansion agent. The total weight of the expansion agent used in each case was 350 g and in each case the two components were present in equal proportions by weight. The FV and PSV results, in percentage increase terms, are shown in Table 1 below. As may be observed from the results, for each expansion agent the FV percentage (Col. 4) was greater than that obtained using either of the two components alone (Cols. 5 and 6). Similarly, all of the expansion agents produced PSV percentage increases (Col. 7) greater than those of the respective components when each was used alone (Cols. 8 and 9).

TABLE 1

| 1 EXAMPLE | 2 Comp$^t$ 1 | 3 Comp$^t$ 2 | 4 FV (1 + 2) | 5 FV (1) | 6 FV (2) | 7 PSV (1 + 2) | 8 PSV (1) | 9 PSV (2) |
|---|---|---|---|---|---|---|---|---|
| III | n-hexane | acetone | 55 | 36 | 36 | 84 | 49 | 59 |
| IV | n-pentane | methyl formate | 85 | 77 | 33 | 147 | 126 | 55 |
| V | n-pentane | methyl acetate | 80 | 77 | 30 | 143 | 126 | 59 |
| VI | n-hexane | methyl formate | 52 | 36 | 33 | 82 | 49 | 55 |
| VII | Freon*-11 | acetone | 83 | 71 | 36 | 119 | 110 | 59 |

*Freon is a Trade Mark
(Freon-11 is trichlorofluoromethane)

Figure 3:
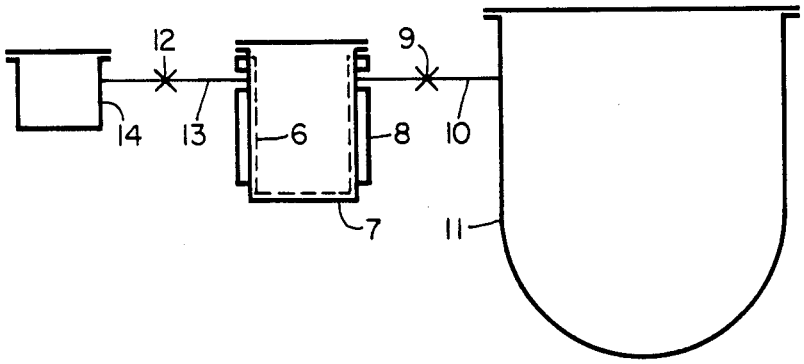
FIG. 3 diagrammatically depicts tobacco expansion apparatus used in respect of Examples VIII–XI.

EXAMPLE VIII 20 g of tobacco, being a blend wholly comprised of flue-cured lamina tobaccos, at a moisture content of 20% wet weight was placed in a basket 6 within a 2 liter pressure vessel 7 (see FIG. 3) and an expansion agent comprised of 48 g Freon-11 and 20 g acetone was poured over the tobacco. After the vessel had been closed, and after the elapse of several minutes to permit equilibration, the vessel was, without being evacuated, heated, by means of a steam jacket 8, to produce a temperature of 160° C. at the inner wall surface of the vessel, which resulted in a pressure of 700 kPa absolute in the vessel. After maintaining these conditions for a five minutes equilibration period, the pressure vessel was vented, by opening valve 9 in line 10, to a substantially constant vacuum of 14 kPa absolute obtaining in a vessel 11. It was determined that the filling power of the tobacco after subjection to this expansion process, and after equilibration to 12.5% wet weight moisture content, was increased by 71% as compared with a unexpanded, equilibrated control tobacco, whereas for Freon-11 and acetone, when each was used alone, the corresponding filling power increases were 61% and 30% respectively. Filling power increase in this case was measured in a small-sample cylinder fill value test, using only 5 g of tobacco. Such a determination is hereinafter referred to by the designation "FP".

EXAMPLE IX 20 g of a tobacco at room temperature, which tobacco was of a type the same as that of Example VIII but which was at a moisture content of 25% wet weight, was placed in the basket 6 in the first pressure vessel 7 which had been pre-heated to provide a temperature at the inner wall surface of the vessel 7 of 150° C. After the pressure vessel 7 had been closed, and without evacuating the vessel 7, valve 12 in line 13 was opened to put the interior of the vessel 7 into communication with the interior of a second pressure vessel 14. There had been put into the second pressure vessel 14 an expansion agent comprising an 80%:20% by volume mixture of n-pentane and acetone. The second pressure vessel 14 had then been heated, by electric heating means (not shown) to provide within the second pressure vessel 14 an elevated temperature and a pressure of about 800 kPa absolute. Thus at the time when the interiors of the two vessels 7, 14 were put into communication, expansion agent in both vapour and liquid phase was present in the second pressure vessel 14. Vapour phase expansion agent flowed to the pressure vessel 7 from the pressure vessel 14 and condensed in contact with the tobacco in the pressure vessel 7.

The interior of the pressure vessel 7 was then isolated from the interior of the pressure vessel 14 by closing valve 12. After the elapse of an equilibration period of five minutes, at the end of which time the wall surface temperature of the vessel 7 was 160° C. and the pressure in the pressure vessel 7 was 520 kPa absolute, the pressure vessel 7 was vented, by opening valve 9, to a substantially constant vacuum of 14 kPa absolute.

It was determined that the FP increase of the tobacco, after equilibration to 12.5% wet weight moisture content, was 72%, whereas for n-pentane and acetone alone the FP increases were 46% and 26% respectively.

EXAMPLE X

The expansion process of Example IX was repeated, excepting that before the interiors of the two pressure vessels 7, 14 were put into communication, the vessel 7 was evacuated to 20 kPa absolute. At the end of the five minutes equilibration period the wall temperature of the vessel 7 was 160° C. and the pressure in the vessel 7 was 500 kPa absolute.

The FP increase was determined to be 86%.

EXAMPLE XI

The expansion process of Example VIII was repeated, excepting that the initial wet weight moisture content of the tobacco was 25% and the tobacco was treated with the expansion agent before the tobacco was placed in the pressure vessel 7. The expansion agent added to the tobacco was comprised of 3 g n-pentane and 8 g acetone. At the end of the five minutes equilibration period the pressure in the vessel 7 was 305 kPa absolute.

The FP increase was determined to be 88%.

EXAMPLES XII–XVII

The expansion process of Example II was repeated six times, using each time a different two-component expansion agent. The total weight of the expansion agent used in each case was 350 g and in each case the two components were present in equal proportions by weight. The initial wet weight moisture content of the flue-cured lamina blend was in each case 24%.

As may be seen from Table 2 below, for each expansion agent the FV and PSV percentage increases (Cols. 4 and 7) were greater than those obtained using either of the two components alone (Cols. 5, 6 and 8, 9).

TABLE 2

| 1<br>EXAMPLE | 2<br>Comp$^f$ 1 | 3<br>Comp$^f$ 2 | 4<br>FV (1 + 2) | 5<br>FV (1) | 6<br>FV (2) | 7<br>PSV (1 + 2) | 8<br>PSV (1) | 9<br>PSV (2) |
|---|---|---|---|---|---|---|---|---|
| XII | cyclopentane | acetone | 94 | 62 | 49 | 135 | 79 | 73 |
| XIII | n-hexene | acetone | 86 | 49 | 49 | 112 | 59 | 73 |
| XIV | methylpentane | acetone | 80 | 30 | 49 | 109 | 22 | 73 |
| XV | n-pentane | acetone | 105 | 76 | 49 | 138 | 84 | 73 |
| XVI | n-hexene | ethanol | 90 | 49 | 31 | 133 | 59 | 16 |
| XVII | n-hexene | methyl formate | 88 | 49 | 46 | 109 | 59 | 47 |

EXAMPLES XVIII AND XIX

The expansion process of Examples XII–XVII was repeated twice. In the first case both of the components of the two-component expansion agent were of the first compound type. In the second case both components were of the second compound type.

As may be seen from Table 3 below, for each of these expansion agents the FV and PSV percentage increases (Cols. 4 and 7) are even less than would be expected on a linearly proportional basis from the increases for each of the components.

TABLE 3

| 1<br>EXAMPLE | 2<br>Comp$^f$ | 3<br>Comp$^f$ | 4<br>FV (A + B) | 5<br>FV (A) | 6<br>FV (B) | 7<br>PSV (A + B) | 8<br>PSV (A) | 9<br>PSV (B) |
|---|---|---|---|---|---|---|---|---|
| XVIII | n-pentane A | | | 76 | | | 84 | |
| | n-hexane B | | 51 | | 46 | 53 | | 43 |
| XIX | | methyl formate A | | 46 | | | 47 | |
| | | acetone B | 41 | | 49 | 57 | | 73 |

What is claimed is:

1. A tobacco expansion process, which comprises;

treating the tobacco with an expansion agent which comprises a two component mixture, said agent comprising as a first component a first organic compound which is volatile, non-polar and substantially water insoluble, and as a second component a second organic compound which is volatile, water soluble, oxygen containing and of a polarity in excess of that of said first compound; and subjecting the treated tobacco to heating and/or a reduction in pressure; whereby the filling power increase is greater than the increase expected on a linearly proportional basis from the increases for each of the components of said agent.

2. The process of claim 1 wherein said first component and said second component are miscible when each is in the liquid phase.

3. The process of claim 1 wherein said first component is a hydrocarbon.

4. The process of claim 3, wherein said hydrocarbon is a hydrocarbon which has from one to eight carbon atoms in its molecular structure.

5. The process of claim 4, wherein said hydrocarbon is a hydrocarbon which has from three to six carbon atoms in its molecular structure.

6. The process of claim 5 wherein said first component exists in the liquid phase at or near to 20° C. at 100 kPa absolute.

7. The process of claim 6 wherein said first component is a n-pentane.

8. The process of claim 7 wherein said second component is a compound which has from one to six carbon atoms in its molecular structure.

9. The process of claim 8, wherein said second component is a compound which has from one to three carbon atoms in its molecular structure.

10. The process of claim 9 wherein said second component exists in the liquid phase at or near to 20° C. and at 100 kPa absolute.

11. The process of claim 10 wherein said second component is a compound selected from the group consisting of ketones, esters and alcohols.

12. The process of claim 11, wherein said second component is a compound selected from the group consisting of acetone, methyl formate and ethanol.

13. The process of claim 12 wherein the respective atmospheric boiling points of said first component and said second component are within 50° C. of each other.

14. The process of claim 13 wherein said first component and said second component are capable of forming an azeotrope.

15. The process of claim 14, wherein the proportions of said first component and said second component are at or in the region of azeotropic proportions.

16. A process as claimed in claim 1, wherein the heating and/or pressure reduction step effects removal of said agent from said tobacco.

17. A process as claimed in claim 16, wherein said tobacco treated with said expansion agent is fed into a duct through which is flowing a gaseous medium at elevated temperature, said tobacco being thereafter separated from said medium in separator means.

18. A process as claimed in claim 16, wherein said tobacco treated with said expansion agent is heated in a closed vessel so that the temperature of said agent in the liquid phase in said tobacco attains a temperature value above the boiling point of said agent corresponding to a release pressure lower than the pressure in the vessel at said temperature value, and the vessel is then vented to said release pressure.

19. A process is claimed in claim 1 wherein the treatment of said tobacco with the agent comprises the addition of the first component to the tobacco separate and independently from the addition of the second component to the tobacco whereby there is effected an in-situ mixing of the first and second components at said tobacco.

* * * * *